US011686241B1

(12) United States Patent
Schneider et al.

(10) Patent No.: US 11,686,241 B1
(45) Date of Patent: Jun. 27, 2023

(54) EFFICIENT MACHINE AUXILIARY CONTROL

(71) Applicant: Caterpillar Inc., Peoria, IL (US)

(72) Inventors: Karl P. Schneider, Decatur, IL (US); Cameron T. Lane, Oro Valley, AZ (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/729,573

(22) Filed: Apr. 26, 2022

(51) Int. Cl.
*F01P 7/04* (2006.01)

(52) U.S. Cl.
CPC ..... *F01P 7/04* (2013.01)

(58) Field of Classification Search
CPC ..... F01P 1/00; F01P 1/06; F01P 5/02
See application file for complete search history.

(56) References Cited

U.S. PATENT DOCUMENTS

| | | | | |
|---|---|---|---|---|
| 6,480,767 | B2 | 11/2002 | Yamaguchi et al. | |
| 7,642,787 | B2 | 1/2010 | Bertness et al. | |
| 9,032,725 | B2 | 5/2015 | Filla | |
| 9,574,327 | B2 | 2/2017 | Ishihara et al. | |
| 9,623,765 | B2 | 4/2017 | Liu | |
| 10,017,174 | B2 | 7/2018 | Wang et al. | |
| 2008/0173101 | A1* | 7/2008 | Sowle | G01M 17/007 73/862.09 |
| 2012/0168140 | A1* | 7/2012 | Yokkoyama | B60L 3/003 165/200 |
| 2015/0307077 | A1* | 10/2015 | Xing | B60W 30/1888 701/50 |
| 2015/0367834 | A1* | 12/2015 | Runde | B60W 50/0097 180/65.265 |
| 2019/0202378 | A1* | 7/2019 | Hartman | B60R 16/0236 |
| 2019/0202379 | A1* | 7/2019 | Omran | B60W 30/1882 |
| 2020/0274375 | A1* | 8/2020 | Griffiths | B60R 16/033 |

FOREIGN PATENT DOCUMENTS

| | | |
|---|---|---|
| CN | 104175905 | 12/2014 |

* cited by examiner

*Primary Examiner* — Long T Tran
(74) *Attorney, Agent, or Firm* — Schwegman, Lundberg & Woessner

(57) ABSTRACT

A system for efficient machine control may include feedback devices for identifying operating conditions of a work machine and a controller for controlling a primary system and an auxiliary system. The controller may calculate a total energy loss by adding a primary system energy loss based on power requests from the primary system to an auxiliary system energy loss based on support requests from the auxiliary system. The controller may adjust a setting of the auxiliary system, repeat the calculating of the total energy loss, and compare the result to a previously calculated total energy loss until further adjustment of the setting fails to reduce the total energy loss. The controller may then send control requests to the auxiliary system based on the setting used when the total energy loss failed to reduce.

20 Claims, 4 Drawing Sheets

EFFICIENT MACHINE AUXILIARY CONTROL

TECHNICAL FIELD

The present disclosure generally relates to managing work machine operating efficiency. More particularly, the present disclosure relates to targeting highly efficient operating conditions by considering trade offs between multiple systems of the work machine. Still more particularly, the present disclosure relates to iteratively calculating work machine efficiency by adjusting several machine parameters to arrive at a highly efficient set of operating parameters and operating the machine at those parameters.

BACKGROUND

Work machines may have a high number of systems that are operated by a common source of power. For example, a work machine with a combustion engine may operate to power a drive shaft for driving a traction system for moving the work machine along the ground. A power take-off may function to operate a wide variety of additional systems including hydraulic systems, water cooling pumps, cooling fans, generators, and other components. The power take-off may operate at an engine speed that is dictated by motive power or hydraulic power demands of the work machine and the other systems may be mechanically tied to operation at that speed. An electrically powered work machine may include a similar or same set of systems that are powered by a battery or external power source (e.g., a trolley system). Since the power source is electrically stored power as opposed to kinetic rotational energy, many of the systems may operate at speeds that are independent of the speeds of other systems. Battery cooling, for example, may include a fan, chillers, fluid pumps, and/or heat exchangers to establish refrigerant circuits. The fan may be for circulating air through, around, or across the battery and a motor driving the fan may operate at a speed independent of the motor providing motive power the machine. Similarly, the motor driving the fluid pump may operate independently of the drive motor of the machine. Similarly, battery heating may operate independent of machine motor speed and may draw electrical power through a heating coil, for example. In some cases, operation of the battery cooling fan or heater may operate based on a desired range of battery temperatures that are selected to allow the battery to suitably function and/or to avoid undue damage to the battery and premature failure. However, any further consideration of the efficiencies of the system as whole may not be provided.

U.S. Pat. No. 9,032,725 relates to a method for operating a working machine including the steps of providing a model predicting a power demanded by at least one of the power consuming systems, detecting at least one operational parameter indicative of a power demand, using the detected operational parameter in the prediction model, and balancing a provided power to the demanded power according to the prediction model.

SUMMARY

In one or more examples, a system for efficient machine control may include a plurality of feedback devices for identifying operating conditions of a work machine and a controller in communication with the plurality of feedback devices and in controlling communication with a primary system and an auxiliary system. The controller may include a processor and a computer readable storage medium having computer implemented instructions stored thereon for performing a method of efficient machine operation. The method may include calculating a total energy loss. This may include calculating primary system energy loss based on power requests from the primary system, calculating auxiliary system energy loss based on support requests from the auxiliary system, and adding the primary system energy loss and the auxiliary system energy loss to arrive at the total energy loss. The method may also include adjusting a setting of the auxiliary system, repeating the calculating of the total energy loss, and comparing the result to a previously calculated total energy loss until further adjustment of the setting fails to reduce the total energy loss. The method may also include sending control requests to the auxiliary system based on the setting used when the total energy loss failed to reduce.

In one or more other examples, a work machine comprising a power source, a primary system for operation by the power source, and an auxiliary system for supporting operation of the primary system. The work machine may also include a system for efficient machine control. The system may include a plurality of feedback devices for identifying operating conditions of a work machine and a controller in communication with the plurality of feedback devices and in controlling communication with a primary system and an auxiliary system. The controller may include a processor and a computer readable storage medium having computer implemented instructions stored thereon for performing a method of efficient machine operation. The method may include calculating a total energy loss by calculating primary system energy loss based on power requests from the primary system, calculating auxiliary system energy loss based on support requests from the auxiliary system, and adding the primary system energy loss and the auxiliary system energy loss to arrive at the total energy loss. The method may also include adjusting a setting of the auxiliary system, repeating the calculating of the total energy loss, and comparing the result to a previously calculated total energy loss until further adjustment of the setting fails to reduce the total energy loss. The method may also include sending control requests to the auxiliary system based on the setting used when the total energy loss failed to reduce.

In one or more other examples, a method of efficient machine operation may include calculating a total energy loss by calculating primary system energy loss based on power requests from the primary system, calculating auxiliary system energy loss based on support requests from the auxiliary system, and adding the primary system energy loss and the auxiliary system energy loss to arrive at the total energy loss. The method may also include adjusting a setting of the auxiliary system, repeating the calculating of the total energy loss, and comparing the result to a previously calculated total energy loss until further adjustment of the setting fails to reduce the total energy loss. The method may also include sending control requests to the auxiliary system based on the setting used when the total energy loss failed to reduce.

DETAILED DESCRIPTION

Figure 1:
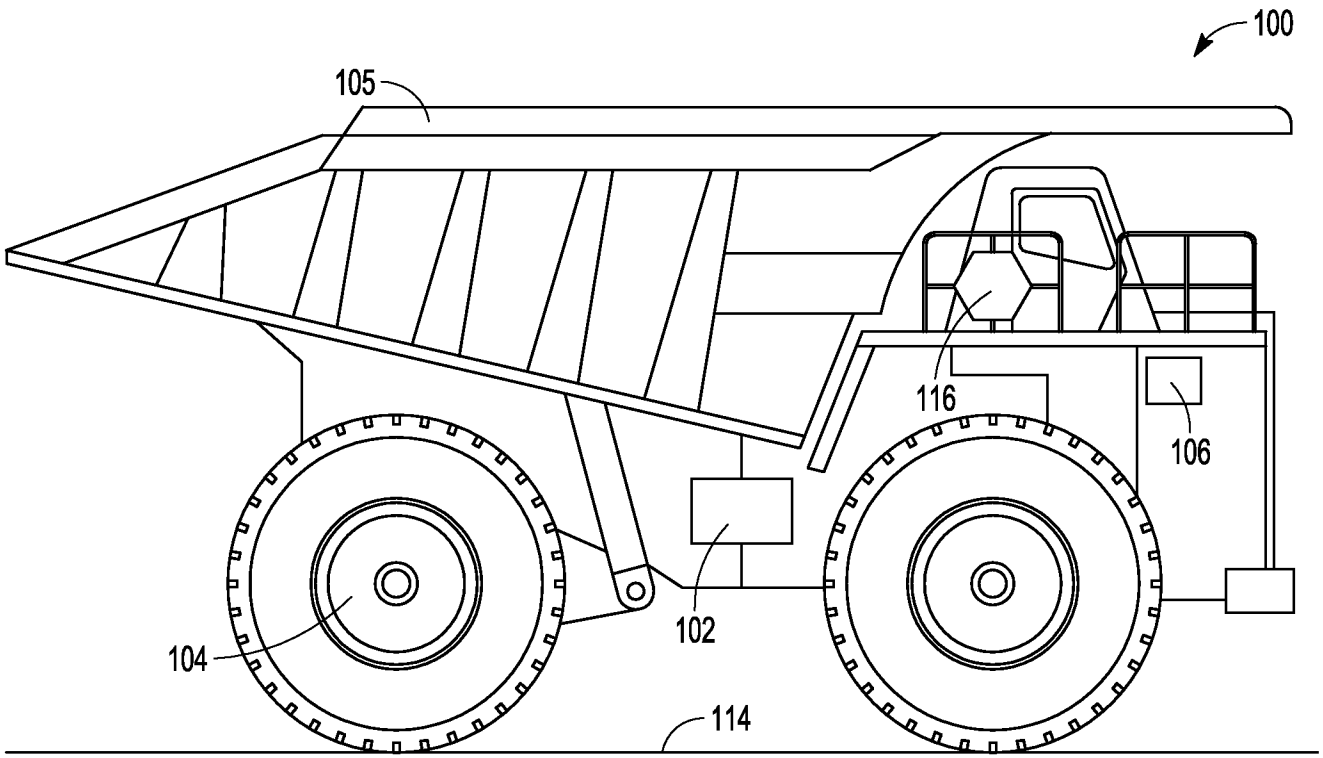
FIG. 1 is a perspective view of a work machine having several operable systems and an efficient machine auxiliary control, according to one or more examples.
Figure 2:
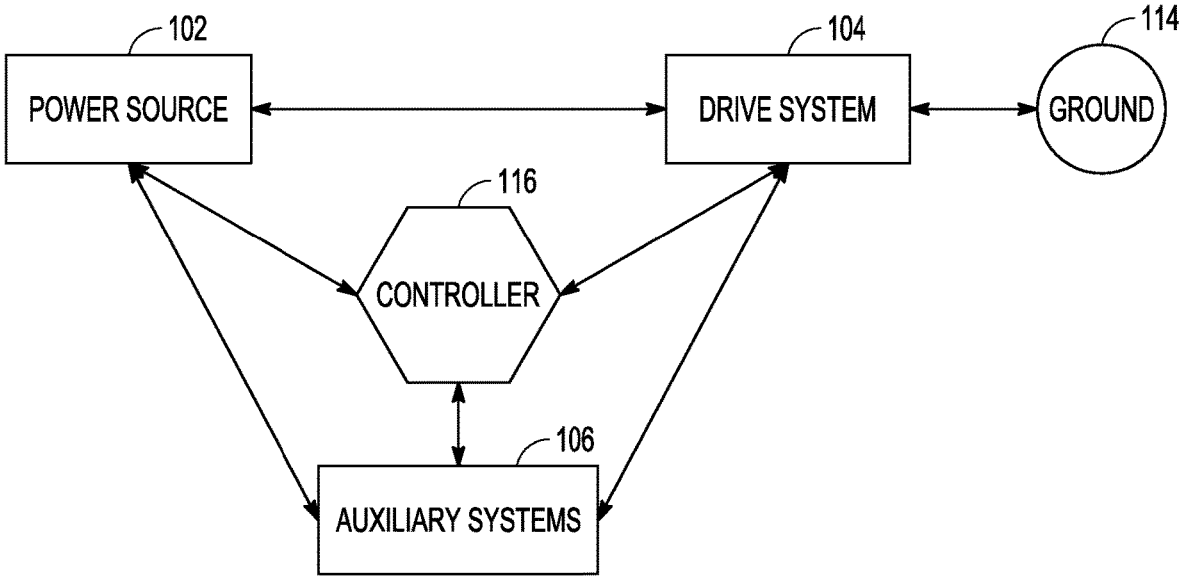
FIG. 2 is a schematic diagram of one or more systems of the work machine, according to one or more examples.

FIG. 1 is a perspective view of a work machine 100, according to one or more examples. The work machine 100 may be configured to be mobile to move to, from, through, and/or across a work site and may also be configured to perform work such as by use of a work implement of the work machine. As shown in FIGS. 1 and 2, the work machine 100 may include a power source 102 and primary operation systems such as a drive system 104 and one or more work implements 105. In addition, the work machine 100 may include several auxiliary systems 106 that may function to operate or support the operation of the power source 102 and the primary systems.

The power source 102 may be configured to provide power in the form of rotational energy or electrical power. That is, the power source 102 may take the form of a combustion engine such as a gas or diesel engine that may generate rotational energy by burning fuel. Alternatively or additionally, the power source may be in the form of a battery 108 that may store electrical energy for use by one or more systems of the work machine. Another type of power source 102 applicable to use of the efficient machine auxiliary control is a fuel cell 110. Yet another type of power source is an external power source such as a trolley system that may include overhead power lines and contacts on the work machine for receiving electrical power from the power lines. In one or more examples, the system may include a combustion engine, a battery 108, a fuel cell 110, an external power system or a combination of one or more of the power systems may be provided.

Power may be delivered to the primary operation systems through power electronics 112. That is, the power source 102 may include electrical systems configured for controlling delivery of electrical power to the drive system 104 and/or one or more work implements. The power electronics may include motors, transformers (e.g., voltage level), inverters (e.g., DC-AC), rectifiers (e.g., DC-AC), voltage regulators, storage (e.g., battery capacitors), dissipators (e.g., resistive grid) and other electronic systems configured to deliver power to the drive system or one or more work implements. Still other electronic devices may be used to make up the power electronics.

The drive system 104 may be configured to leverage rotational energy or electrical energy from the power source to allow the work machine to move along a surface such as the ground 114. For example, the drive system 104 may include an electric motor and drive shaft that delivers rotational energy to a traction system to turn wheels, rollers, cogs, or other types of traction systems configured for engaging the ground and moving the work machine along the ground. In some cases, the drive system 104 may include a transmission for adjusting the speed/power of rotational power from the electric motor or from a power take-off on a combustion engine, for example. The drive system 104 may also include systems and mechanisms for steering and braking of the work machine.

The work implement 105 may be configured to perform work related to its respective type of work machine 100. For example, in one example, the work machine 100 may be in the form of a haul truck and the work implement 105 may include a dump body operable by the hydraulic system to tip the dump body between a haul position and a more upright dump position. In other examples, the work machine 100 may include an excavator with a work implement 105 in the form of a one or more booms and a bucket. The work machine 100 may also be a loader with work implement 105 in the form of a linkage and a bucket. Still other types of work machines 100 with respective work implements 105 may be provided such as a bulldozer or skid steer with arms and a blade, forks, or bucket, or a compactor with one or more rollers and a vibration system. Still other types of work machines 100 with respective types of implements 105 may be provided and are contemplated for control by the efficient machine auxiliary control 116.

Turning now to the auxiliary system 106 and as shown in FIGS. 1 and 2, the auxiliary systems may function directly or indirectly to support the power source 102, the primary systems, and/or one or more other auxiliary systems. For example, a hydraulic system may function to directly support the work implement 105 by operating the implement. A heating and/or cooling system 118 may function indirectly to support the power system 102, the hydraulic system 120, or one or more other systems by controlling the temperature of the respective system. In other examples, the hydraulic system 120 may function to provide power to one or more aspects of the cooling system 118 such as by running a cooling fan, for example. A wide variety of auxiliary systems 106 may be provided and managed by the efficient machine auxiliary control 116. For purposes of example and discussion, the auxiliary systems may include a hydraulic system 120, a cooling system 118, and an electrical system 122. As discussed in more detail below with respect to FIG. 3, each of these systems may have various features that are controlled by the efficient machine auxiliary control 116 and an iterative process of determining the most efficient combination of settings of the several features may be performed.

The hydraulic system 120 may be configured to provide power to the implement 105 or other systems on the work machine 100 such as brakes, steering and lubrication, the cooling system 118, or other systems. The hydraulic system 120 may include a reservoir for storing hydraulic fluid and a pump, such as an electrically driven pump, for pumping the hydraulic fluid from the reservoir to other parts of the system. The system 120 may include a series of hydraulic lines for carrying the hydraulic fluid from the pump to other aspects of the hydraulic system 120, one or more valves for controlling the flow of the hydraulic fluid, and one or more working elements such as a hydraulic cylinder, a turbine, a hydraulic motor to drive rotational components (e.g., fans, compressors, other pumps, etc.) or other device for leveraging the fluid flow in the hydraulic system 120. Still other devices or features of the hydraulic system 120 may be provided.

The cooling system 118 may include an air or liquid-cooling system. In the case of an air-cooled system, the system 118 may include one or more external air intakes and a circulation fan and one or more circulation paths passing along items to be cooled such as the battery 108, power electronics components such as motors or power converters, or other systems, for example. In the case of a liquid-cooling system, the system may include a heat exchanger such as a radiator, for example. The radiator may include a fluid coil such as fins or other fluid conduit having a relatively large surface area for transferring heat from the fluid within the fins to air passing across the fins. The liquid cooling system may also include a hydraulically or electrically driven water pump for pumping the fluid through radiator to be cooled and back through or around operating components to collect heat from those components. For example, the liquid cooling system may include fluid conduits arranged adjacent to a battery 108 or other components for collecting heat therefrom. Once heated, the fluid may travel through conduits back to the radiator other heat exchanger for releasing the heat to the air flowing across the radiator fins. In one or more examples, a compressor may be provided for compressing the fluid after it collects heat from the system. Like the air-cooled system, the liquid or fluid cooling system may include one or more air intakes and a circulation fan for causing the air to flow across the fins of the radiator or other heat exchanger and air exits to release the heated air from the work machine. The cooling system may directly cool the battery or other electronics or may indirectly cool these items by using a heat exchanger to cool a liquid that then cools the battery.

The electrical system 122 may be configured to operate one or more aspects of the auxiliary system 106 and may include, for example, electrical components for operating the other auxiliary systems. That is, for example, an electric motor for running the above-mentioned hydraulic pump may be provided or an electric motor for running the above-mentioned cooling fan may be provided. Transformers, voltage regulators, AC/DC converters, and other electrical components may also be provided as part of the electrical system 122.

The efficient machine auxiliary control 116 may be configured to manage the operations of the work machine 100 in an efficient manner based on an ongoing analysis of the several systems in operation on the work machine 100. The efficient machine auxiliary control 116 may be a computing device including software, hardware, or a combination thereof. The computing device may include a processor and a computer-readable storage medium for storing computer-implemented instructions and for collecting and storing (either in Random-Access Memory or more permanent or longer-term memory) sensor or other feedback data that provides data or information to the controller about the operation of the various aspects of the work machine 100. For example, a wide variety of sensors or other feedback systems or devices may be in data communication with the control 116 to provide information about machine operations.

Regarding feedback devices in the form of sensors, in one or more examples, temperature sensors for measuring component temperatures or ambient temperatures may be provided. Speed sensors for measuring machine speed, component speed such as motor speed, or fluid speed may also be provided. Still further, pressure sensors for measuring fluid pressures or ambient pressures may be provided. Voltage and/or current sensors, fluid gauges, fuel gauges, and other sensors may also be provided.

Other feedback devices and systems (e.g., in addition to or as an alterative to sensors) may also be provided. That is, the computer-readable storage medium may also store a series of maps for analyzing component or system performance. For example, load maps, heat transfer maps, efficiency maps, and/or H2 consumption maps may be stored in the computer-readable storage medium.

Still other feedback systems and methods for determining current (or even anticipated) operating conditions may be provided. In one or more examples, machine learning from past cycles may be used to identify operating conditions. For example, if the previous cycle (based on distance or geographical location) had an occurrence of inefficient system behavior due to an overheat, pre-cooling would may be advantageous. Conversely, if the heat load is known to be high but temporary, the controller could allow the system to intermittently run hot knowing it will dissipate shortly. As such, while sensors and maps may be provided to assess operating conditions, other relevant feedback may involve providing the processor with information about what is to come, so preemptive measures can be taken (or not taken) based on this forward looking information. One example may include situations where high power is being exerted prior to approaching a shovel, where a truck is anticipated to idle for a period of time while being loaded. All of these systems including sensors, maps, and machine learning may be deemed feedback systems or devices. Still other types of feedback systems or devices may be provided.

The computer-readable storage medium may also store one or more computer-implemented instructions for analyzing machine efficiency (e.g., energy losses) based on the sensor data. That is, as discussed in more detail with respect to FIG. 3 below, the efficient machine auxiliary control 116 may function to continually or periodically analyze machine performance and/or efficiency and may control the operation of one or more auxiliary systems to operate the machine at a high efficiency level.

Figure 3:
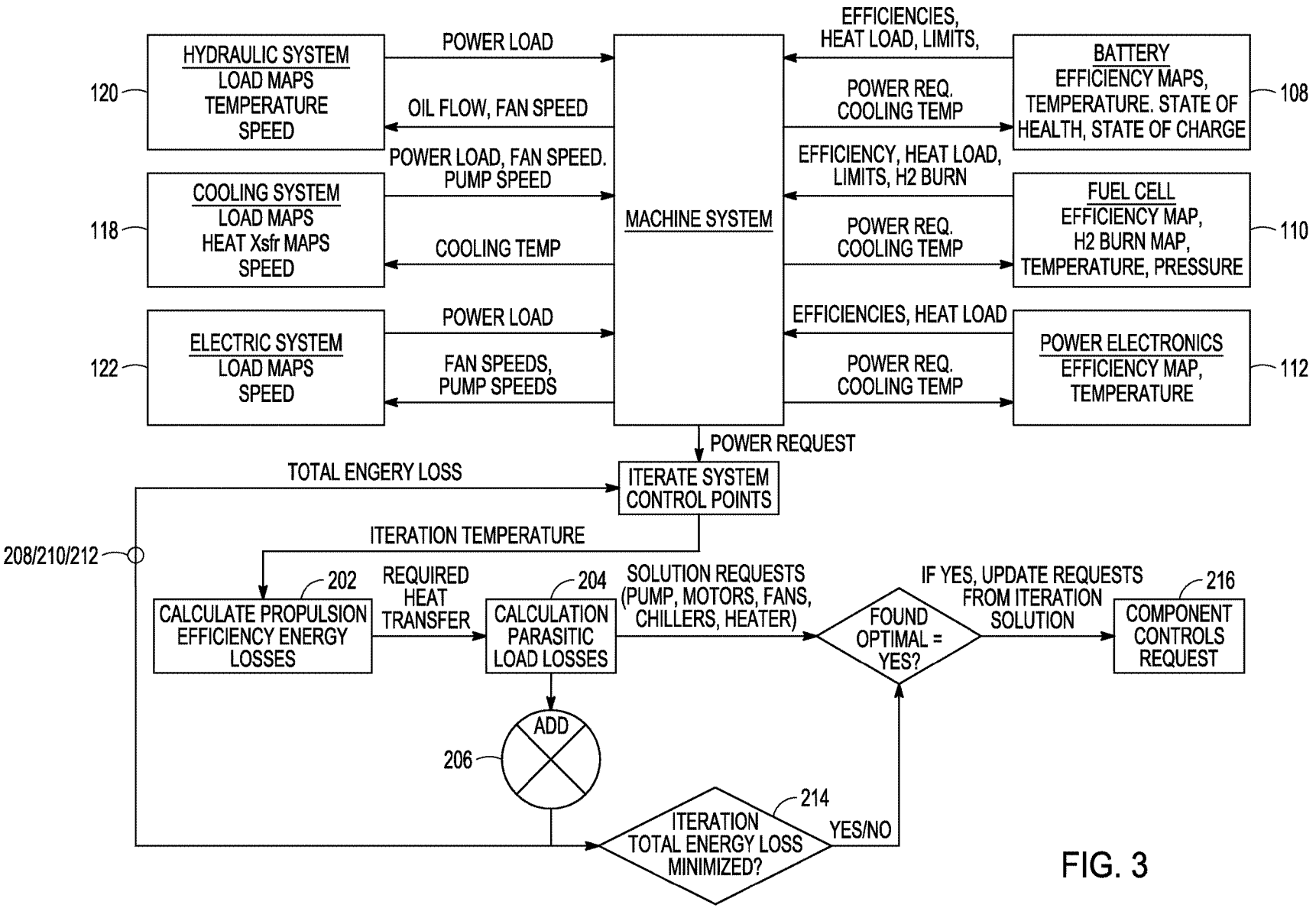
FIG. 3 is a process diagram depicting several considerations and an iteration loop performable by the efficient machine auxiliary control, according to one or more examples.

Turning now to FIG. 3, a process diagram depicting several considerations and an iteration loop performable by the efficient machine auxiliary control 116 is shown. For purposes of discussion of FIG. 3, a simplified set of systems may be referenced. For example, consider a work machine 100 having a power source 102 in the form of a battery 108 and/or a fuel cell 110 and power electronics 112 for delivering power from the battery 108 and/or fuel cell 110 to a drive system 104 of a work machine 100. (e.g., the boxes on the right side of the machine system of FIG. 3). From an auxiliary system perspective (e.g., the boxes on the left side of the machine system of FIG. 3), consider a cooling system 118 having a fluid routing system with an electrically driven cooling pump, a radiator, and a hydraulically driven cooling fan. For the hydraulic system 120, consider a fluid reservoir, an electrically driven hydraulic pump, a fluid routing system, and a turbine for driving the cooling fan. For the electrical system 122, consider electrical motors for running the hydraulic pump and the cooling pump. In some examples, the electrical system 122 may also run a cooling fan, for example.

As shown in FIG. 3, each of these systems 118, 120, and 122 may interact with the overall system in a variety of ways and the efficient machine auxiliary control 116 may analyze the performance of each system when considering the most efficient operation of the system as whole.

For example, the hydraulic system 120 may receive a request for a particular oil flow or, in the case of a hydraulically driven fan, a fan speed. Based on one or more load maps, temperatures, and/or speeds, the hydraulic system may put a power load on the overall system. That is, for example, to generate a requested oil flow, a hydraulic pump may need to run a particular speed with a particular displacement and a load map may provide a power load on the system for the requested oil flow. The temperature may be relevant to consider the viscosity of the oil, for example, which may affect the power load (e.g, warmer more viscous fluids may be more easily pumped and result in a lower power load).

Similarly, the cooling system 118 may receive a request to deliver a particular cooling temperature. Based on one or more load maps, heat transfer maps, and/or speeds, the cooling system 118 may put a power load on the overall system and/or may put in a request for a particular fan speed and/or pump speed, for example. That is, in order to provide the requested cooling, a heat transfer map may be used to determine how much air flow across a radiator is needed in conjunction with a particular fluid flow through the radiator to transfer the heat and provide the requested cooling. The speed of the vehicle travel, fan speeds, or fluid flow speeds may be used to determine the heat transfer as well. Load maps may then be used to determine the amount of power load such a process will require. Alternatively or additionally, load on the system may be determined elsewhere if, for example, the fan is being driven by a different system (i.e., hydraulic or electric) or if the pump is being driven by a different system. In these circumstances, the cooling system 118 may return a fan speed request, a pump speed request, and/or a pump/motor displacement request.

The electrical system 122 may receive a request for a particular fan speed or pump speed where those elements are electrically driven. Based on one or more load maps and speeds, the electrical system 122 may put a power load on the system. That is, for example, to generate a requested fan speed or pump speed, the electrical system 122 may need to run a motor at a particular rate or speed and a load map may be used to determine a power load on the system.

Turning now to the right side of the machine system, the battery 108 may receive power requests from the primary systems such as the drive system and/or the work implement. In addition, the battery may receive power requests for cooling that may be generated by the several auxiliary systems (i.e., cooling temp power requests). Based on one or more efficiency maps or temperatures, the state of health of the battery, and/or the state of charge, the battery may operate with particular efficiency losses, may generate a heat load on the system, and/or may reach a temperature or heat limit. That is, for example, to generate the requested power, the battery 108 may generate a particular amount of heat at a particular cooling medium temperature which may affect the power load requirements of the cooling system 118 to provide a particular cooling temp. Moreover, the battery 108 may have particular efficiency losses under its current operating conditions (e.g., temperature and load). Some of those losses may be associated with primary power requests (e.g., propulsion efficiency energy losses) and some of those losses may be associated with auxiliary power requests (e.g., parasitic load losses) Both the heat load and the losses may be determined based on efficiency maps, the temperature of the battery, the state of health of the battery and the state of charge of the battery, for example. In some cases, the power requests may push the temperature of the battery to one or more selected limits, which may cause the efficient machine auxiliary control 116 to adjust where power is being requested from or demand cooling aside from whether that is the most efficient approach.

Similarly, the fuel cell 110 may receive a power request from the primary systems and, in addition, may receive power requests for cooling that may be generated by the several auxiliary systems (i.e., cooling temp power requests). Based on one or more efficiency maps, a fuel burn or consumption map, inlet conditions (e.g., temperature and pressure) for air and fuel, cooling temperature and component temperature, the fuel cell may operate with particular efficiency losses, may generate a heat load on the system, may reach a temperature or heat limit, and may consume a particular amount of fuel. As with the battery 108, in some cases, power request may push the fuel cell 110 beyond selected limits such as fuel consumption rate limits or other selected limitations on the fuel cell 110. This may cause the efficient machine auxiliary control 116 to request power from a different source or avoid providing the requested cooling, for example.

Finally, the power electronics 112 may operate with particular efficiency losses depending on operating conditions and may generate a heat load on the system when power is requested from the battery 108 and the fuel cell 110 and when power is, in turn, delivered to the drive system 104, for example. Based on efficiency maps and temperatures of the components, efficiency losses and heat loads on the system may be determined.

While particular systems have been described, other systems may be present on a work machine and may be included in the overall efficient control of the machine. That is, for example, while not described in detail, a work machine may also include one or more primary systems that function to perform the work of the machine and/or move the machine as well as a wide variety of auxiliary systems that play a more supportive role in the operation of the machine. In the case of high-altitude, for example, many systems may de-rate due to the thinner air. For example, the power system could de-rate its performance output to stay within limit or alternatively the cooling system could increase and draw more power. So, the system may allow for focusing on a combination of de-rating power and increasing cooling to deliver the best net performance. That is, it may be better to spend more energy on cooling rather than de-rating or it may be better to de-rate slightly and avoid extra cooling losses. The present system may allow for arriving at the most efficient combination of these factors.

INDUSTRIAL APPLICABILITY

Figure 4:
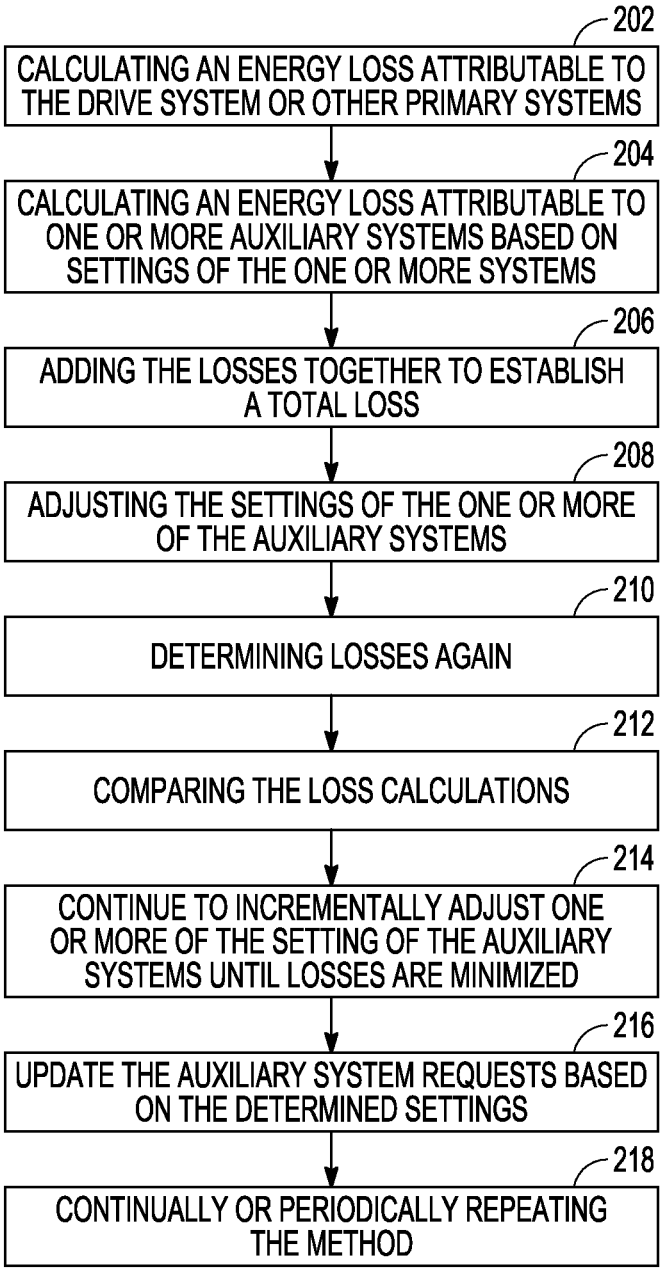
FIG. 4 is a diagram depicting a method of efficient machine auxiliary control, according to one or more examples.

In operation and use, and turning to the bottom of FIG. 3 and to FIG. 4, a method of efficiently operating a work machine 200 may be provided. In particular, the efficient machine auxiliary control 116 may be configured to assess the energy losses associated with particular operating parameters or conditions and may continually or periodically adjust one or more auxiliary and/or primary system settings and calculate energy losses based on those settings. The control may utilize an iterative approach to arrive at settings providing for a lowest amount of aggregate losses amongst the power source, drive system, and auxiliary systems and then may control the work machine accordingly.

In particular, and as shown in FIGS. 3 and 4, the method 200 may involve calculating an energy loss attributable to the drive system or other primary systems 202 and calculating an energy loss attributable to one or more auxiliary systems 204. This calculation may include sensing or reading the power load from the one or more primary systems and analyzing the several auxiliary systems to establish power loads, for example, from each system. The method may also include analyzing the one or more power source systems (i.e., the battery, fuel cell, and/or power electronics) to quantify energy losses (e.g., energy losses from the primary systems and energy losses from the auxiliary systems). The starting point for the auxiliary system analysis may be based on conventional settings used previously like, for example, temperatures that may be currently used to trigger use of a cooling system or the starting point may simply be the current state of the machine operations. That is, for example, the starting point may assume no cooling when machine operation begins because the cooling system is not active. Thereafter, the analysis may use the cooling temp currently being implemented by the machine.

In one or more examples, each analysis may require one or more iterations where, for example, the power load calculated results in a heat load from one or more power sources, which affects the power load calculation of the cooling and related systems. That is, the analysis and calculation of losses may be somewhat iterative in and of itself, but may be performed until the analysis converges on a low or lowest energy loss solution with corresponding set points.

With energy losses from the primary systems and energy losses from the auxiliary system, the method may include adding those losses together to establish a total energy loss 206. Based on the resulting total energy loss, the method may include adjusting the settings of the one or more auxiliary systems 208 for purposes of further calculations. For example, if the cooling system is off and, as such, the power load from the cooling system is zero, the method may include incrementally assuming more cooling is provided to the system and determining losses again 210 and comparing the loss calculations 212. If turning on and running the cooling system increases the losses, this may be an indication that cooling does not help the efficiency of the system and the machine may be running as efficiently as possible with respect to cooling. However, if losses are reduced by increasing the cooling effort, the system may continue to incrementally increase the cooling in the analysis until the increased cooling no longer reduces losses 214. At that point, the system may be said to be running as efficiently as possible, at least with respect to cooling.

Once an efficient operational setting is found, the settings used in the analysis may be used to operate the several systems of the machine by updating the requests being sent to the several systems 216. The method may continue to be repeated automatically or continually, or the analysis may wait for an operating condition to change before performing the method again 218.

The present system may, thus, have an ability to balance tradeoffs between operating and not operating particular auxiliary systems and/or tradeoffs of operating particular systems at particular levels as compared to other levels and may zero in on optimal and/or highly efficient operating settings to maximize battery life and/or the life of another power source. Multiple auxiliary systems may be supported by the same input, such that a balance can be struck as multiple systems may not require the same level of input. For example, a cooling fan may support heat exchangers in series (e.g., one hydraulic and one coolant) and one of the systems may be relatively hotter than the other. One may need to be overcooled while the other may need to be undercooled, or both. Still another example may include a coolant pump and fan cooling system, where a heat transfer or cooled fluid temperature is being requested. In this example, the system may consider many combinations of fan speed and pump speed (e.g., high fan speed, low pump speed; low fan speed, high pump speed; combination thereof), such that an optimal combination of control set points can be determined within the ancillary system to meet the power system requested goals.

In addition to managing system demands in a reactive manner, the system may also be forward looking. For example, by knowing the upcoming work assignment or when charging will occur (either through on-board or off-board communication), the system may start cooling at a moderate level ahead of when needed at a high level or to prevent component temperature rise into a less efficient operating point during future high demand. In other words, the system may be proactive instead of reactive. This may allow for delivering the best efficiency/performance over time instead of just considering the instantaneous performance. In another example, if the machine knows it is about to stop and no longer need cooling, it could possible avoid turning on the cooling or limiting the amount of cooling since it knows it will have natural cool-down period coming up soon or alternately turn off cooling once stopped if it knows will have sufficient idle time to naturally cool off with reduced or no forced cooling.

The above detailed description is intended to be illustrative, and not restrictive. The scope of the disclosure should, therefore, be determined with references to the appended claims, along with the full scope of equivalents to which such claims are entitled.

What is claimed is:

1. A system for efficient machine control, comprising:

a plurality of feedback devices for identifying operating conditions of a work machine;

a controller in communication with the plurality of feedback devices and in controlling communication with a primary system and an auxiliary system, the controller comprising a processor and a computer readable storage medium having computer implemented instructions stored thereon for controlling the operation of the primary system, controlling operation of the auxiliary system, and performing a method of efficient machine operation, the method comprising:

calculating a total energy loss by:

calculating primary system energy loss based on power requests from the primary system;

calculating auxiliary system energy loss based on support requests from the auxiliary system; and adding the primary system energy loss and the auxiliary system energy loss to arrive at the total energy loss;

adjusting a setting of the auxiliary system independent of the primary system;

repeating the calculating of the total energy loss and comparing the result to a previously calculated total energy loss until further adjustment of the setting fails to reduce the total energy loss; and sending control requests to the auxiliary system based on the setting used when the total energy loss failed to reduce.

2. The system of claim 1, wherein the auxiliary system comprises a cooling system comprising a cooling fan.

3. The system of claim 2, wherein the plurality of feedback devices include a battery temperature sensor.

4. The system of claim 3, wherein calculating auxiliary system energy losses comprises:

utilizing a load map, a heat transfer map, and a fan speed to determine a power load of the cooling system; and utilizing the power load from the cooling system to determine an energy loss of a battery when operating the cooling system.

5. The system of claim 4, wherein calculating auxiliary system energy losses comprises determining a compressor load to determine a power load of the cooling system.

6. The system of claim 4, wherein calculating auxiliary system energy losses comprises calculating a heat load from the battery.

7. The system of claim 6, wherein calculating auxiliary system energy losses comprises utilizing a load map, a heat transfer map, and a fan speed to determine a power load of the cooling system that accounts for the heat load from the battery.

8. The system of claim 2, wherein the auxiliary system comprises an electrical system for operating the cooling fan.

9. The system of claim 2, wherein the auxiliary system comprises a hydraulic system for operating the cooling fan.

10. The system of claim 9, wherein the plurality of sensors include a pump speed.

11. A work machine comprising:

a power source;

a primary system for operation by the power source;

an auxiliary system for supporting operation of the primary system; and a system for efficient machine control, comprising:

a plurality of feedback devices for identifying operating conditions of a work machine;

a controller in communication with the plurality of feedback devices and in controlling communication with a primary system and an auxiliary system, the controller comprising a processor and a computer readable storage medium having computer implemented instructions stored thereon for performing a method of efficient machine operation, the method comprising:

calculating a total energy loss by:

calculating primary system energy loss based on power requests from the primary system;

calculating auxiliary system energy loss based on support requests from the auxiliary system; and adding the primary system energy loss and the auxiliary system energy loss to arrive at the total energy loss;

adjusting a setting of the auxiliary system independent of the primary system;

repeating the calculating of the total energy loss and comparing the result to a previously calculated total energy loss until further adjustment of the setting fails to reduce the total energy loss; and sending control requests to the auxiliary system based on the setting used when the total energy loss failed to reduce.

12. The work machine of claim 11, wherein the auxiliary system comprises a cooling system comprising a cooling fan.

13. The work machine of claim 12, wherein the plurality of feedback devices include a battery temperature sensor.

14. The work machine of claim 13, wherein calculating auxiliary system energy losses comprises:

utilizing a load map, a heat transfer map, and a fan speed to determine a power load of the cooling system; and utilizing the power load from the cooling system to determine an energy loss of a battery when operating the cooling system.

15. The work machine of claim 14, wherein calculating auxiliary system energy losses comprises determining a compressor load to determine a power load of the cooling system.

16. The work machine of claim 14, wherein calculating auxiliary system energy losses comprises calculating a heat load from the battery.

17. The work machine of claim 16, wherein calculating auxiliary system energy losses comprises utilizing a load map, a heat transfer map, and a fan speed to determine a power load of the cooling system that accounts for the heat load from the battery.

18. The work machine of claim 12, wherein the auxiliary system comprises an electrical system for operating the cooling fan.

19. The work machine of claim 12, wherein the auxiliary system comprises a hydraulic system for operating the cooling fan.

20. A method of efficient machine operation, comprising:

controlling the operation of a primary system of a work machine;

controlling the operation of an auxiliary system configured to support operations of the primary system;

calculating a total energy loss by:

calculating primary system energy loss based on power requests from the primary system;

calculating auxiliary system energy loss based on support requests from the auxiliary system; and adding the primary system energy loss and the auxiliary system energy loss to arrive at the total energy loss;

adjusting a setting of the auxiliary system independent of the primary system;

repeating the calculating of the total energy loss and comparing the result to a previously calculated total energy loss until further adjustment of the setting fails to reduce the total energy loss; and sending control requests to the auxiliary system based on the setting used when the total energy loss failed to reduce.

* * * * *